US008798488B2

(12) United States Patent
Ishikuro

(10) Patent No.: US 8,798,488 B2
(45) Date of Patent: Aug. 5, 2014

(54) IMAGE FORMING APPARATUS INCLUDING GUIDE AND ATTRACTING MEMBERS

(75) Inventor: Takemasa Ishikuro, Tokyo (JP)

(73) Assignee: Oki Data Corporation, Tokyo (JP)

( * ) Notice: Subject to any disclaimer, the term of this patent is extended or adjusted under 35 U.S.C. 154(b) by 84 days.

(21) Appl. No.: 13/473,585

(22) Filed: May 16, 2012

(65) Prior Publication Data

US 2012/0294644 A1 Nov. 22, 2012

(30) Foreign Application Priority Data

May 17, 2011 (JP) ..... 2011-109972

(51) Int. Cl.
*G03G 15/00* (2006.01)

(52) U.S. Cl.
USPC ..... 399/44; 399/400

(58) Field of Classification Search
USPC ..... 399/44, 397, 400
See application file for complete search history.

(56) References Cited

U.S. PATENT DOCUMENTS

2007/0147920 A1* 6/2007 Shimizu ..... 399/400

FOREIGN PATENT DOCUMENTS

| | | |
|---|---|---|
| JP | 7-319298 | 12/1995 |
| JP | 9-160400 | 6/1997 |
| JP | 2002-091217 A | 3/2002 |
| JP | 2002-182491 | 6/2002 |
| JP | 2002-328552 | 11/2002 |

* cited by examiner

*Primary Examiner* — Hoang Ngo
(74) *Attorney, Agent, or Firm* — Rabin & Berdo, P.C.

(57) ABSTRACT

An image forming apparatus includes an attracting member and a guide member. The attracting member extends along a transport path. A print medium carries a developer image thereon and is transported on the guide member in the transport path after passing through a transfer section. The guide member is disposed downstream of the transfer section and is disposed at a position where when the print medium is transported in the transport path, the attracting member attracts the electrostatically toward the attracting member such that the print medium is spaced a distance from the attracting member by the guide member.

18 Claims, 10 Drawing Sheets

FIG.9

| TEMPERATURE X (INITIAL VALUE 25°C) HUMIDITY Y (INITIAL VALUE 50%) | TRANSFER VOLTAGE V1 (INITIAL VALUE 1.2kV) | NEUTRALIZATION VOLTAGE V2 (INITIAL VALUE 0V) |
|---|---|---|
| X≤20°C, Y≤30% | V1L(3kV) | V2L(-300V) |
| 20°C<X<30°C 30%<Y<70% | V1M(2.1kV) | V2M(0V) |
| X≥30°C, Y≥70% | V1H(1.8kV) | V2H(+100V) |

IMAGE FORMING APPARATUS INCLUDING GUIDE AND ATTRACTING MEMBERS

BACKGROUND OF THE INVENTION

1. Field of the Invention

The present invention relates to an image forming apparatus such as a copying machine and a page printer, and particularly to a medium transporting section for transporting sheets of a print medium to a transfer section and then to a succeeding section downstream of the transfer section.

2. Description of the Related Art

Existing electrophotographic printers include, for example, laser printers and light emitting diode (LED) printers. These printers incorporate transfer rollers for transferring toner images formed in respective image forming units. The transfer rollers receive a transfer voltage from a power supply, the transfer voltage creating an electric field by which the toner images are transferred onto the print medium.

Such electrophotographic printers may suffer from a problem in that the medium is charged by the voltage applied for transferring the toner images onto the print medium. In order to neutralize the charge on the medium, some printers employ a neutralizing brush at a location downstream of the transfer sections aligned along the transport path of the medium. Japanese Patent Publication NO. 2002-091217 discloses one such electrophotographic printer.

This printer suffers from, for example, a problem in that when the print medium is transported from the transfer section to the fixing unit, the distance between the print medium and the neutralizing member may change depending on the type of print medium after transferring, possibly causing a poor neutralizing effect.

SUMMARY OF THE INVENTION

The present invention was made in view of the aforementioned drawbacks.

An object of the invention is to provide an image forming apparatus capable of transporting a print medium after transferring toner images onto the print medium while ensuring reliable neutralization effects.

An image forming apparatus includes an attracting member and a guide member. The guide member is located downstream of a transfer section, and guides a print medium that carries a developer image thereon and is transported in a transport path. The attracting member extends in a direction parallel to the transport path. The attracting member is disposed at a position where when the print medium is guided by the guide member, the attracting member attracts the print medium toward the attracting member such that the guide member is sandwiched between the print medium and the attracting member.

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF THE DRAWINGS

The present invention will become more fully understood from the detailed description given hereinbelow and the accompanying drawings which are given by way of illustration only, and thus are not limiting the present invention, and wherein:

FIG. 9 illustrates the transfer voltage and neutralization voltage for various ranges of environment temperature and environment humidity.

DETAILED DESCRIPTION OF THE INVENTION

Embodiments of the present invention will be described with reference to the accompanying drawings.

First Embodiment

Figure 1:
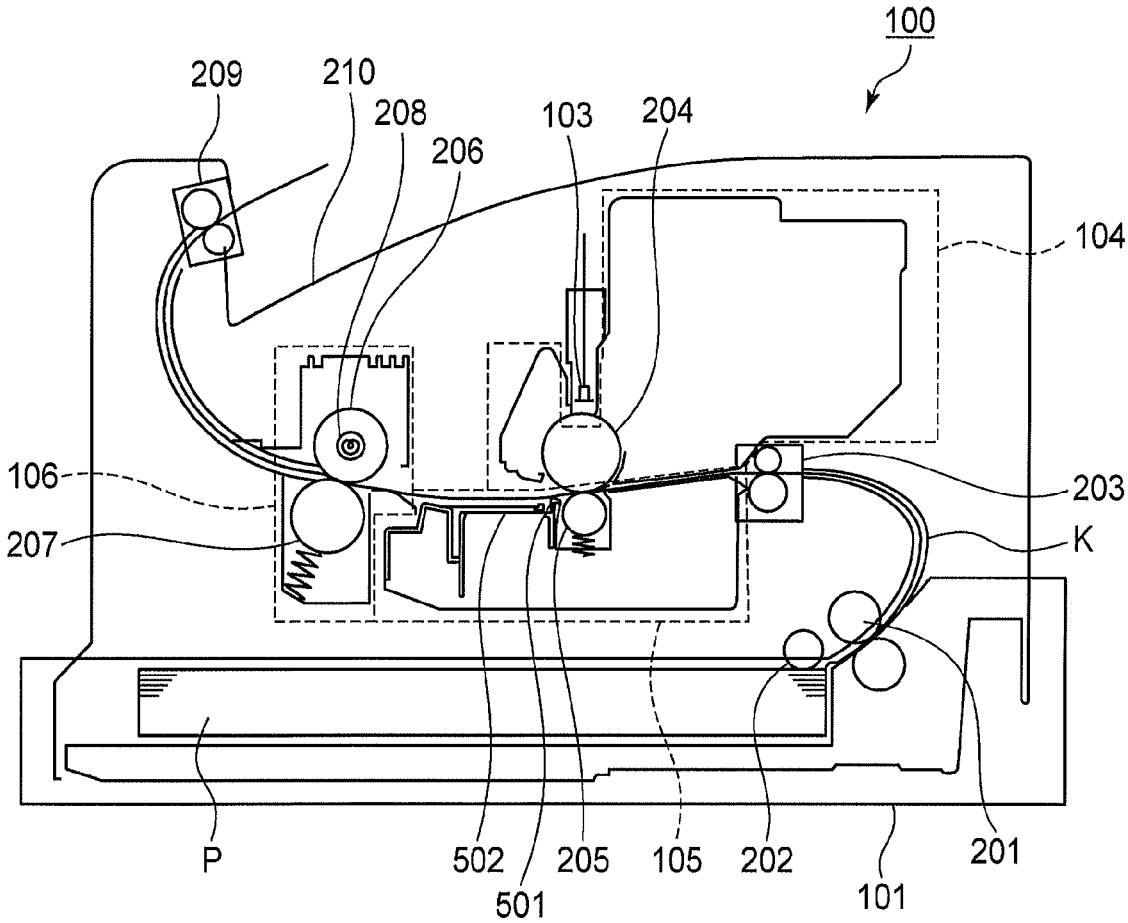
FIG. 1 illustrates a general configuration of a printer according to the present invention.

FIG. 1 illustrates a general configuration of a printer 100 according to the present invention.

A printer 100 includes a paper cassette 101, a feed roller 201, a registry roller 203, a discharge roller 209, and a stacker 210 which are aligned in this order along a generally S-shaped transport path K of a print medium P.

The paper cassette 101 holds a stack of the print medium P therein, and is attached to a lower portion of the printer 100. A hopping roller 202 feeds the top sheet of a stack of print medium P or paper P from the paper cassette 101 on a sheet-by-sheet basis into the transport path K. The feed roller 201 transports the print medium P toward the registry roller 203.

The registry roller 203 corrects skew of the print medium P before transporting the print medium P further to a transfer unit 105.

The discharge roller 209 transports the print medium P, which has passed the fixing unit 106, onto the stacker 210 formed on the top of the printer 100.

A light emitting diode (LED) head 103 includes light emitting elements or LEDs and a lens array, and illuminates the charged surface of the photoconductive drum 204 in accordance with print data to form an electrostatic latent image on the photoconductive drum 204.

The image forming unit 104 is located beside the transport path K and develops the electrostatic latent image into a toner image.

The transfer unit 105 includes a transfer roller 205, a metal plate 501, and a transport guide 502. The transfer roller 205 is urged by a sprint against the photoconductive drum 204.

The transfer roller 205 receives a transfer voltage V1 (e.g., 1 kV) from a high voltage power supply, and creates an electric field across the transfer roller 205 and the photoconductive drum 204, thereby transferring the toner image from the photoconductive drum 204 onto the print medium P sandwiched between the transfer roller 205 and the photoconductive drum 204. When the photoconductive drum 204 and the transfer roller 205 rotate, the print medium P sandwiched therebetween is transported.

The metal plate 501 is in a single-piece construction and includes a neutralizing portion 501*a* and an attracting portion 501*b* with a saw-toothed edge or a triangular wave form edge. The attracting portion 501*b* is continuous to the 501*a* and extends along the transport path K downstream of the neutralizing portion 501*a*. After transferring the toner image onto the print medium P, the print medium P further advances on the transport guide 502 to the fixing unit 106. When the print medium P passes over the saw-toothed edge of the neutralizing portion 501*a*, the charge remaining on the print medium P is discharged through the air between the print medium P and the neutralizing portion 501*a*, thereby neutralizing the charge remaining on the non-image surface of the print medium P. The metal plate 501 receives a neutralization voltage V2 (e.g., 0 volts) from a power supply (not shown). When the print medium P passes over the attracting portion 501*b*, the attracting portion 501*b* gently attracts the print medium P due to the difference in potential between the voltage applied to the metal plate 501 and the charge remaining on the image side of the print medium P.

Figure 2:
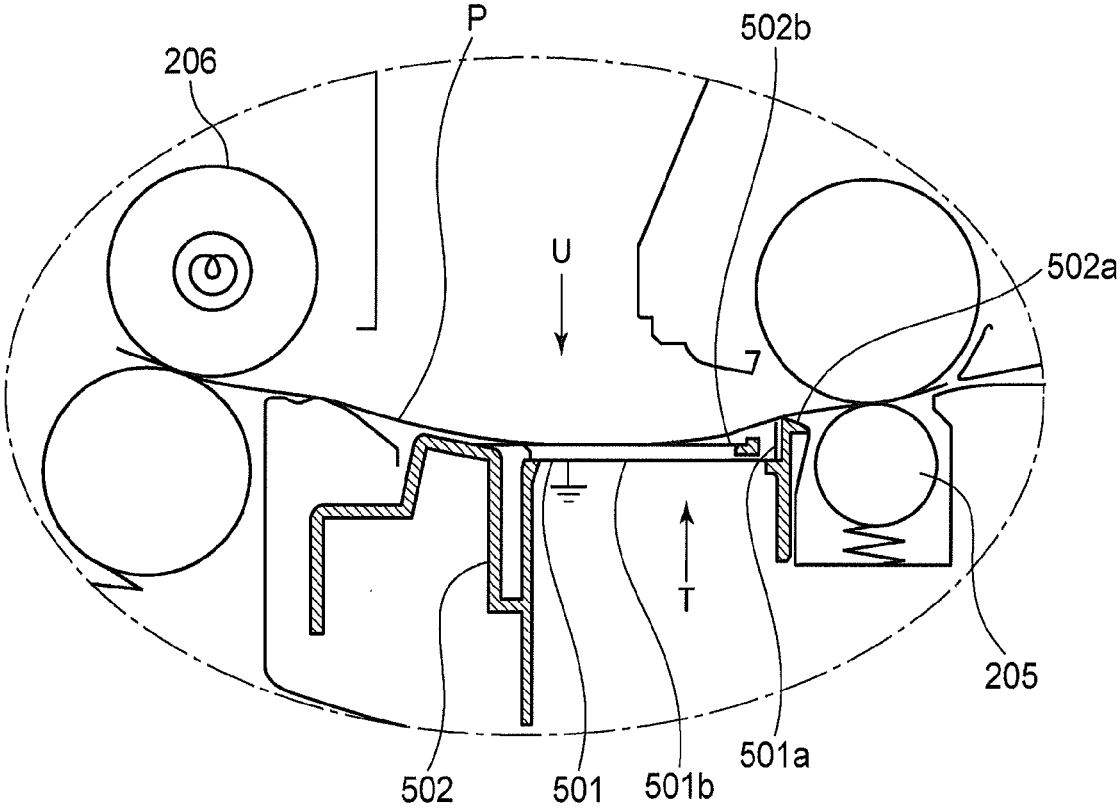
FIG. 2 is a cross-sectional view of a portion in the vicinity of a transfer unit.
Figure 3:
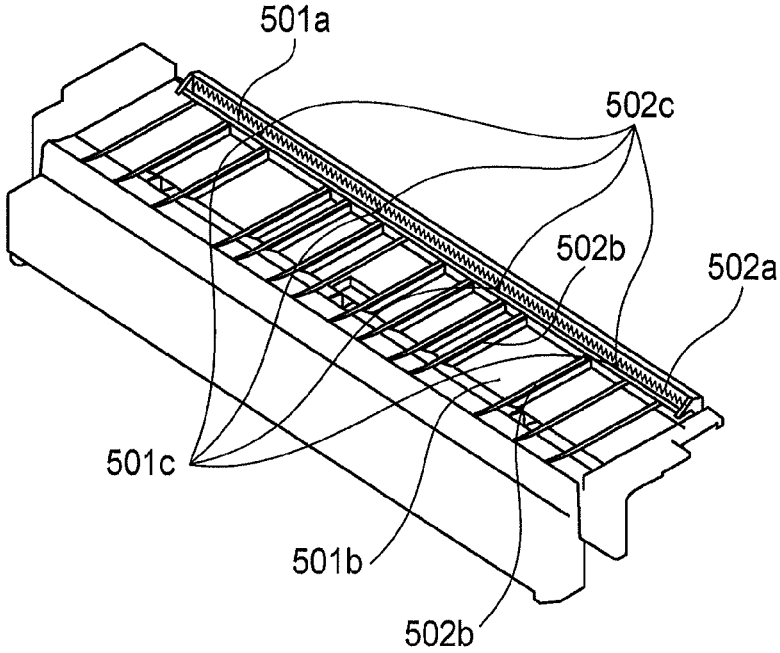
FIG. 3 is a perspective view of a portion of the transport guide.

FIG. 2 is a cross-sectional view of a portion between the fixing unit and the transfer unit 105. FIG. 3 is a perspective view of a portion of the transport guide 502.

The transport guide 502 and the metal plate 501 are disposed between the transfer roller 205 and the fixing roller 206, and form a part of the transport path K of the print medium P. The transport guide 502 is formed of insulating material and includes a space defining portion 502*a* and guide portions 502*b* in a single piece construction. The difference in height between the space defining portion 502*a* and guide portions 502*b* is about 2.8 mm.

The metal plate 501 is formed of, for example, a piece of tinplate (SPTE-T3) having a thickness t of 0.15 mm. The metal plate 501 has four horizontally extending elongate holes or slots 501*c* (FIG. 5F) formed therein, and is connected to a ground potential via a metal strip formed of a piece of metal plate, for example, a phosphor-bronze plate (not shown).

Since the transport guide 502 is located near the fixing roller 206 that generates heat, the transport guide 502 is formed of an electrically insulating, fire-retardant resin, for example, denaturated-Polyphenyleneether.

The neutralizing portion 501*a* is positioned relative to a space defining portion 502*a* so that the top of the neutralizing portion 501*a* is slightly lower than the top of the space defining portion 502*a*. The metal plate 501 is generally L-shaped with the attracting portion 501*b* extending substantially horizontally and the neutralizing portion 501*a* extending substantially vertically. The guide portions 502*b* (FIG. 3) extend over the attracting portion 501*b*, and guide the print medium P when the print medium P advances on the guide portions 502*b* to the fixing unit 106. The space defining portion 502*a* includes four projections 502*c* that project substantially horizontally from the guide portion 502, and that are aligned horizontally. The slots 501*c* receive four projections therein, facilitating the assembly of the metal plate 501 into the transport guide 502.

Figure 4:
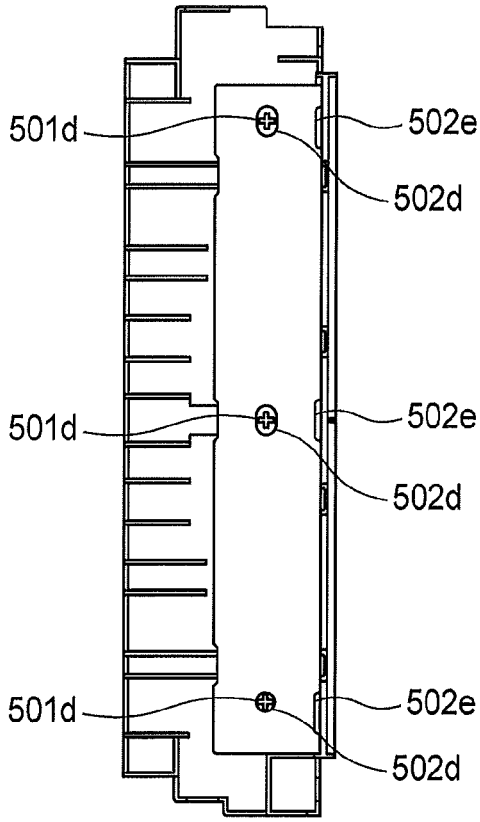
FIG. 4 illustrates the positional relation between a transport guide and a metal plate.

FIG. 4 illustrates the positional relation between the transport guide 502 and the metal plate 501 when they are seen in a direction shown by arrow T shown in FIG. 2. The metal plate 501 includes the vertical slots 501*c* formed at three locations. The three guide portions 502*b* each include a post 502*d*. The metal plate 501 and the transport guide 502 are assembled together so that each post 502*d* fits into a corresponding one of the slots 501*c*. The transport guide 502 includes projections 502*e* that help positioning of the metal plate 501 relative to the space defining portion 502*a*.

Figure 5A:
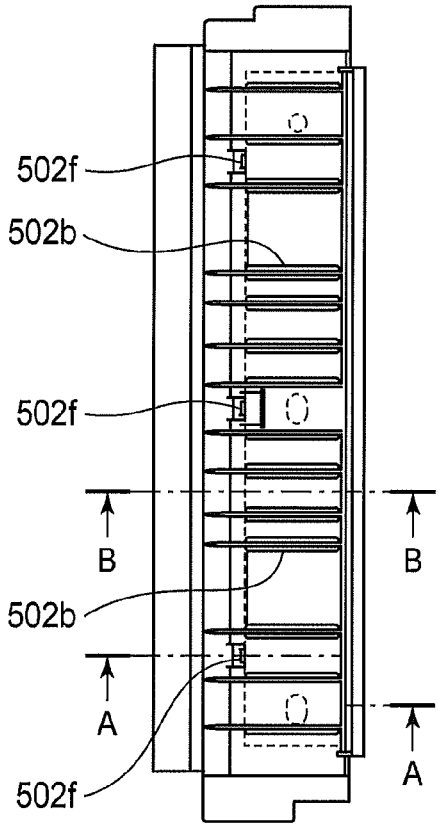
FIG. 5A illustrates the positional relation between the transport guide and the metal plate.

FIG. 5A illustrates the positional relation between the transport guide 502 and the metal plate 501 when they are seen in a direction shown by arrow U shown in FIG. 2.

The transport guide 502 further includes three horizontally extending short ribs 502*f*. When the metal plate 501 is assembled to the transport guide 502, the short ribs 52*f* flex, facilitating the mounting of the metal plate 501. Upon completion of assembly, the short ribs 52*f* and the guide portions 502*b* cooperate to hold the metal plate 501 therebetween, thereby placing the metal plate 501 in position.

Figure 5B:
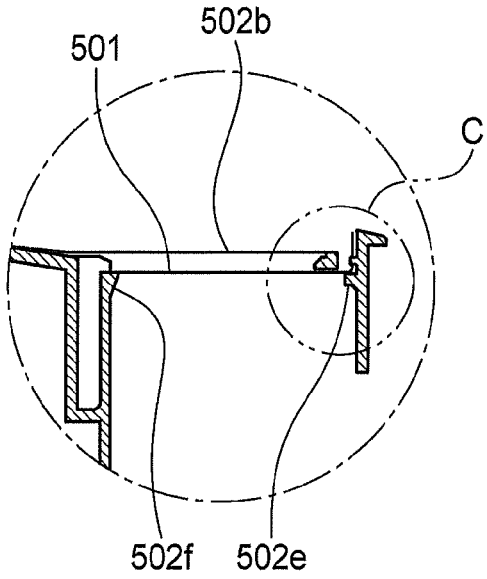
FIG. 5B is a cross-sectional view taken along a line A-A in FIG. 5A.

FIG. 5B is a cross-sectional view taken along a line A-A in FIG. 5A.

Figure 5C:
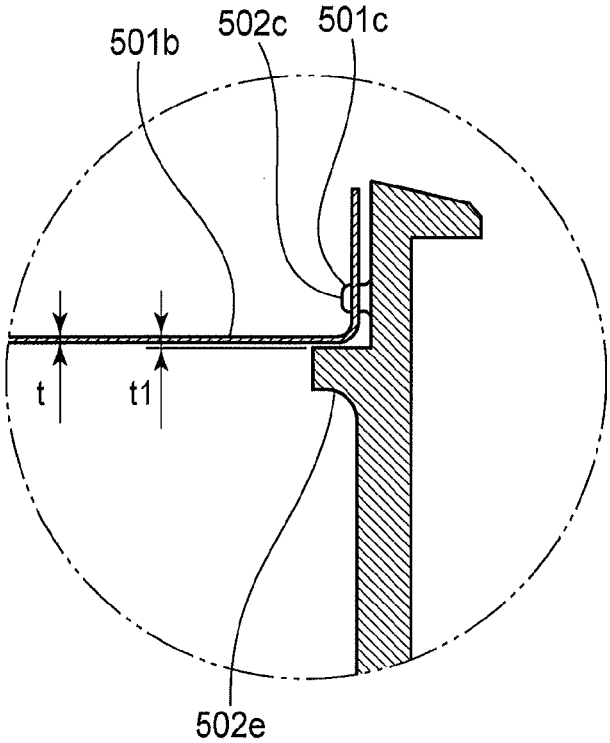
FIG. 5C is partially expanded view of a portion depicted by "C" in FIG. 5B.

FIG. 5C is a partially expanded view of a portion depicted by "C" in FIG. 5B. The metal plate 501 is assembled to the transport guide 502 with a gap t1 between the metal plate 501 and the projections 502*e*. The gap t1 is 0.1 mm in the first embodiment.

Figure 5D:
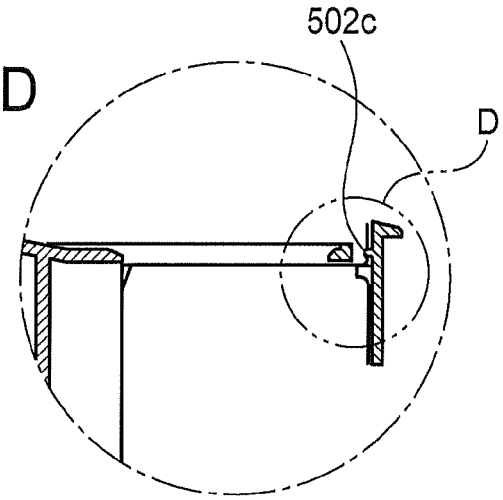
FIG. 5D is a cross-sectional view taken along a line B-B in FIG. 5A.

FIG. 5D is a cross-sectional view taken along a line B-B in FIG. 5A.

Figure 5E:
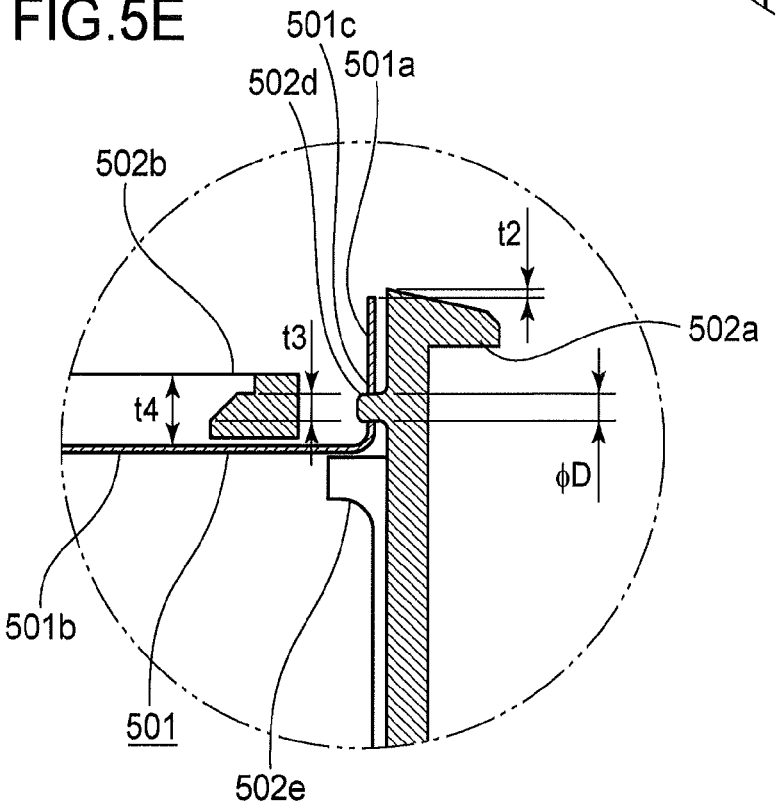
FIG. 5E is a partial expanded view of a portion depicted by "D" in FIG. 5D.

FIG. 5E is a partial expanded view of a portion depicted by "D" in FIG. 5D.

Figure 5F:
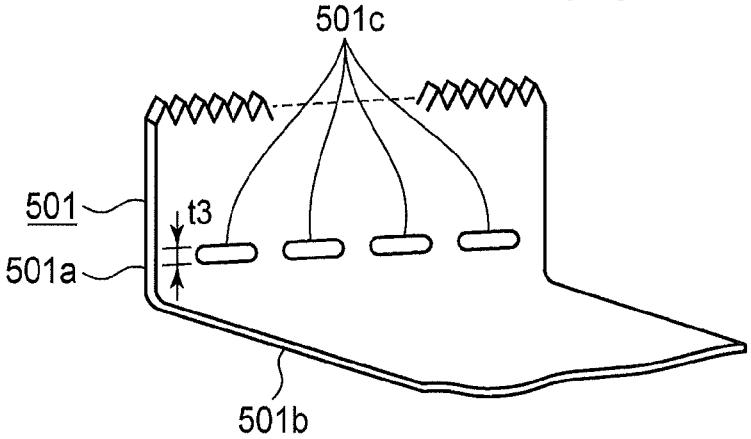
FIG. 5F is a partial perspective view of a metal plate.

FIG. 5F is a partial perspective view of the metal plate 501.

The height of the neutralizing portion 501*a* is lower than the space defining portion 502*a* by a distance t2. The slots 501*c* extend horizontally. The projections 502*d* have a diameter D, and extend through the slots 501*c* so that the metal plate 501 may be adjusted in position horizontally relative to the projections 502*d*. The dimensions are selected as follows: The difference in height between the space defining portion 502*a* and the neutralizing portion 501*a* is t2=0.5 mm, the length of the slots 501*c* is t3=1.025±0.02 mm, and the diameter D of the projections 502*d* is D=0.975±0.025 mm. The distance between the spacer 502*b* and the metal plate 501 is t4=2.5 mm.

The fixing unit 106 is disposed downstream of the image forming unit 104 with respect to the transport path K, and includes the fixing roller 206, a pressure roller 207, and a thermistor. The fixing roller 206 includes a hollow cylindrical core metal of, for example, aluminum. The hollow cylindrical core metal is covered with a heat-resistant elastic layer formed of silicone rubber, which in turn is covered with a tube formed of perfluoro alkyl vinyl ether (PFA). A heater 208 in the form of, for example, a halogen lamp is disposed in the core metal of the fixing roller 206. The pressure roller 207 includes a core metal formed of, for example, aluminum. The core metal is covered with a heat-resistant elastic layer formed of silicone rubber, which in turn is covered with a tube formed of perfluoro alkyl vinyl ether (PFA). The pressure roller 207 is urged by a spring against the fixing roller 206 to form a nip between the pressure roller 207 and the fixing roller 206. The thermistor is disposed in proximity to the fixing roller 206, and detects the temperature of the fixing roller 206. The electric power supplied to the heater 208 is controlled by a heater controller 910*a* based on the detected temperature, thereby maintaining the surface temperature of the fixing roller 206 within a predetermined range. When the print medium P passes through the nip formed between the pressure roller 207 and the fixing roller 206, the toner image on the print medium P is fused by heat and pressure into a permanent image.

The image forming process of the printer 100 with the aforementioned configuration will be described below.

The print medium P is first fed by the feed roller 201 and the hopping roller 202 into the transport path K, and is then transported toward the registry roller 203. The registry roller 203 corrects skew of the print medium P, and then feeds the print medium P to a transfer point defined between the photoconductive drum 204 and the transfer roller 205.

The LED head 103 illuminates the charged surface of the photoconductive drum 204 in accordance with the print data to form an electrostatic latent image on the photoconductive drum 204. The toner is then supplied to the electrostatic latent image to develop the electrostatic latent image with toner into a toner image.

As the print medium P passes through the transfer point, the toner image is transferred onto the print medium P.

The print medium P is further transported over the neutralizing portion 501*a* of the metal plate 501 so that the charge remaining on the non-image side of the print medium P is neutralized. The print medium P passes over the transport guide 502 to the fixing unit 106.

The print medium P carrying the toner image thereon passes through the fixing point defined between the fixing roller 206 and pressure roller 207 where the toner image is fused by heat and pressure into a permanent image.

The discharge roller 209 discharges the print medium P onto the stacker 210. This completes the image forming process.

Figure 6A:
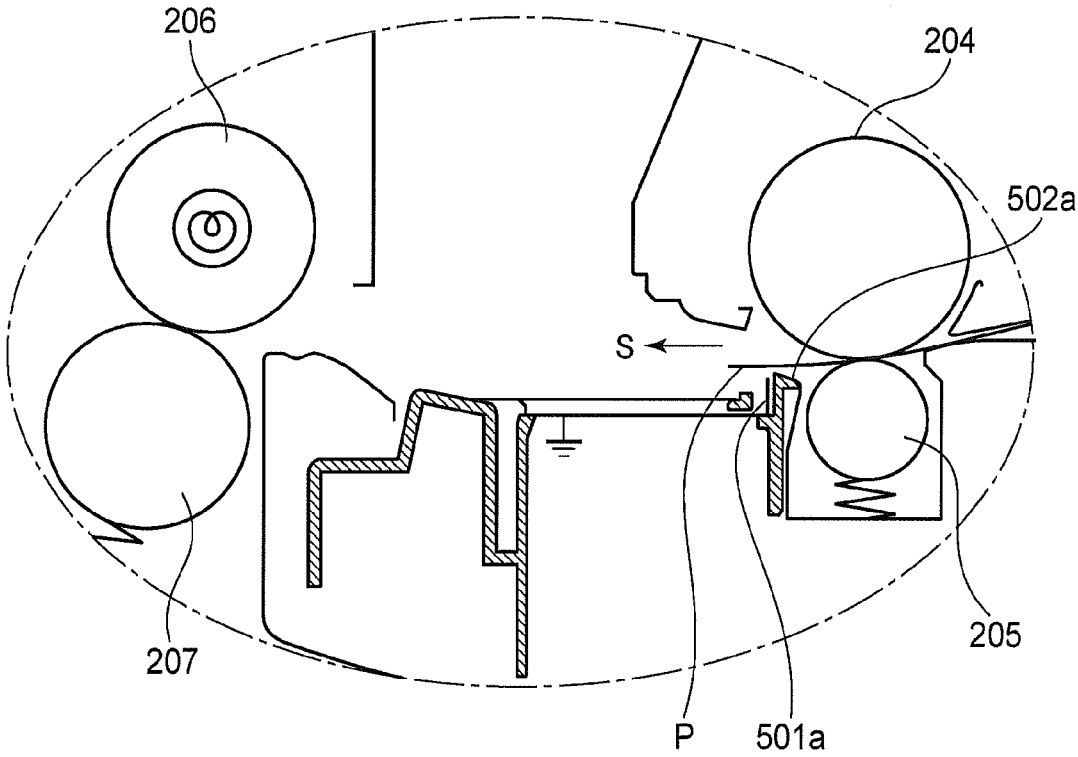
FIGS. 6A-6C are cross-sectional views of a portion between the fixing unit and the most downstream transfer unit.
Figure 6B:
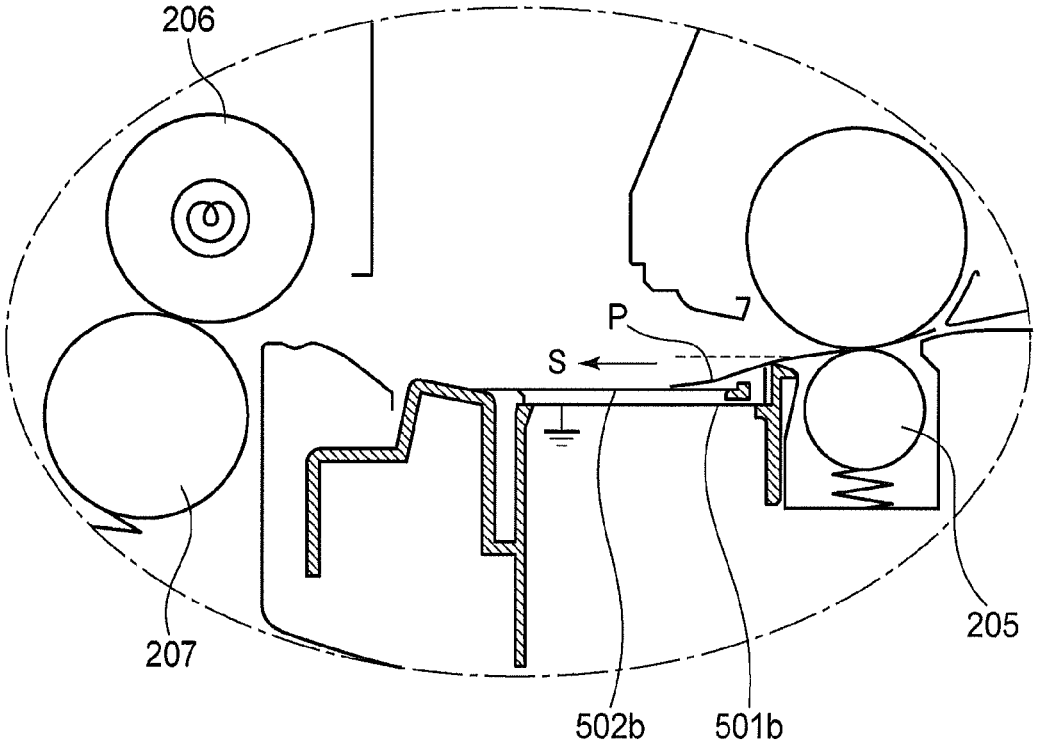
Figure 6C:
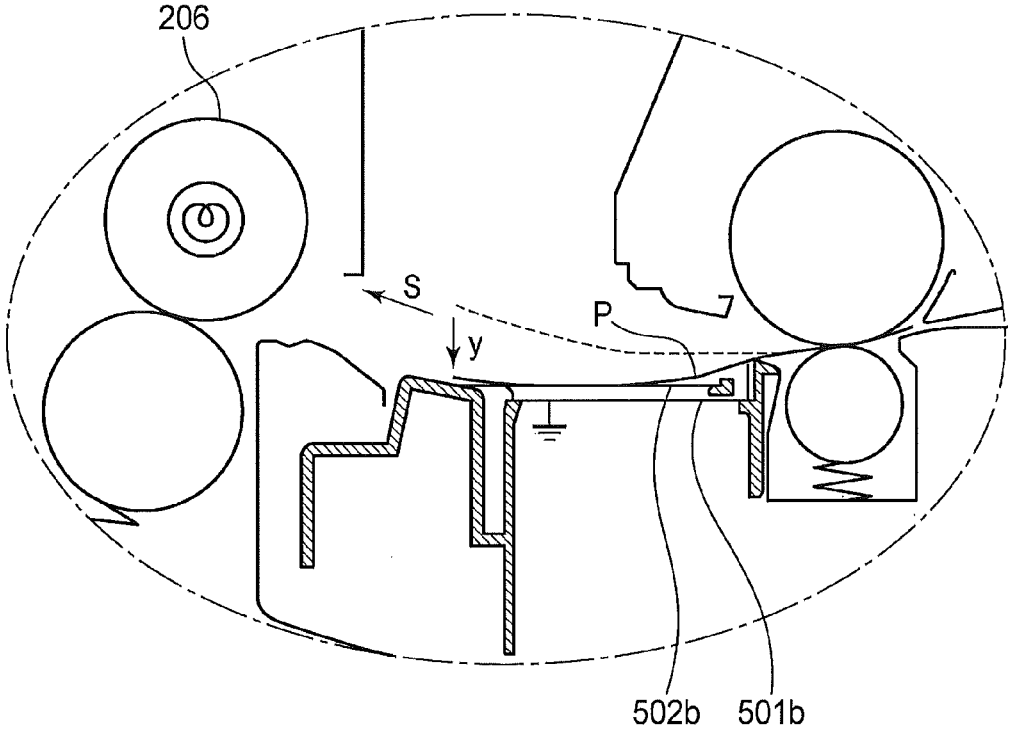

FIGS. 6A-6C are cross-sectional views of a portion between the fixing unit and the transfer unit. The neutralizing process performed during the image forming process will be described with reference to FIGS. 6A-6C.

Referring to FIG. 6A, after the transfer roller 205 has transferred the toner image onto the print medium P, the print medium P advances on the space defining portion 502*a* in a direction shown by arrow S, during which the charge remaining on the non-image side of the print medium P is discharged through the air between the print medium P and the neutralizing portion 501*a*.

As the print medium P advances past the neutralizing portion 501*a* as shown in FIG. 6B, the leading end portion of the print medium P is gently urged against the top of the guide portions 502*b* since the charge remaining on the image side of the print medium P is attracted toward the attracting portion 501*b* connected to the ground potential. The guide portions 502*b* serve to maintain the print medium P spaced a distance t4=2.5 mm from the attracting portion 501*b*.

The print medium P advances toward the fixing unit 106 while being in contact with the guide portion 502*b* as shown by a solid line in FIG. 6C, ensuring that stable, sufficient discharge occurs through the air between the print medium P and the neutralizing portion 501*a*.

If the attracting portion 501*b* is not present, the print medium P would not be attracted toward the attracting portion 501*b* but would advance substantially in a direction shown by arrow S so that the leading end portion of the print medium P approaches the guide portion 502*b* only due to gravity. This, however, causes distortion of the unfused toner image.

In this manner, the print medium P is advanced from the image forming section 104 to the fixing unit 106, so that print medium P is subjected to reliable neutralization of the charge on the print medium P, and so that the print medium P is attracted by the attracting portion 501*b* maintaining a constant distance between the print medium and the attracting portion 501*b* is maintained substantially constant. The present invention eliminates the use of an expensive neutralizing brush, mounting operation of the neutralizing brush with high accuracy, or manufacturing accuracy.

The first embodiment has been described in terms of the metal plate 501 formed of tinplate and a phosphor-bronze plate for grounding. Use of a phosphor-bronze plate used for grounding tends to rust depending on the environment, which may deteriorate the neutralizing effects. Alternatively, the metal plate 501 may be formed of a steel plate which is electroless nickel plated and is therefore resistant to rust, so that the print medium P may be reliably neutralized and advanced toward the fixing unit 106.

As described above—since the metal plate 501 is positioned so that the neutralizing portion 501*a* and the attracting portion 501*b* are spaced by predetermined distances, respectively, from the print medium P. Thus, the print medium P may be reliably neutralized and advanced toward the fixing unit while leaving the toner image on the print medium intact.

Second Embodiment

In general, the electrical resistance of the surface of the print medium P is high in a low-temperature and low-humidity environment, which requires a higher transfer voltage V1 to be applied to the transfer roller 205 during transfer of a toner image onto the print medium P. In such an environment, the amount of charge remaining on the non-image side of the print medium P is relatively larger, and therefore the neutralization performance may not be sufficient. Conversely, in a high-temperature and high-humidity environment, the print medium P contains a larger amount of moisture, and therefore loses its rigidity. In such an environment, the electrical resistance of the surface of the print medium P is relatively low in which case when the charge remaining on the non-image side of the print medium P is discharged, the toner image on the print medium P may be distorted. A second embodiment is directed to a printer in which the transfer voltage V1 applied to the transfer roller 205 and the neutralization voltage V2 applied to the metal plate 501 are adjusted according to the environment temperature and environment humidity in order to minimize distortion of toner images and ensure stable transportation of the print medium P.

Figure 7:
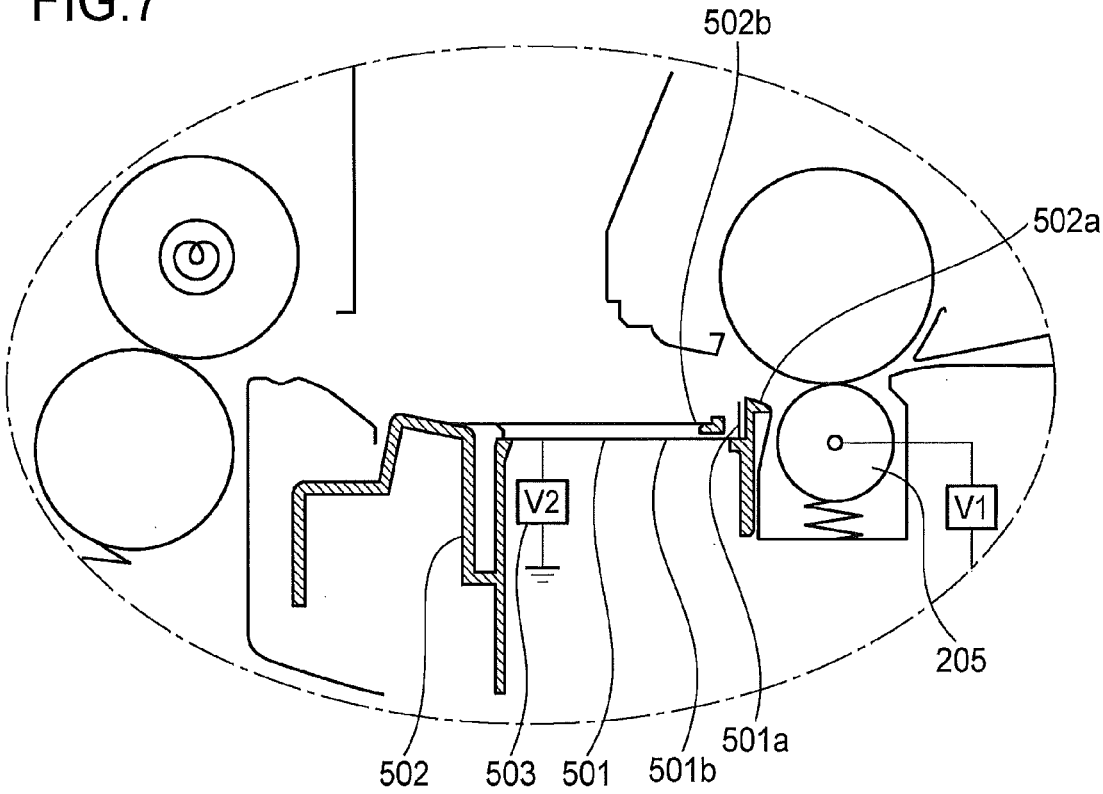
FIG. 7 is a cross-sectional view of a portion in the vicinity of a transfer unit according to a second embodiment.

FIG. 7 is a cross-sectional view of a portion in the vicinity of a transfer unit 105 according to the second embodiment. Elements similar to those of the first embodiment have been given the common reference characters and their description is omitted.

The print medium P is advanced through a transport path K from a transfer roller 205 to a fixing roller 206. A transport guide 502 formed of insulating material and a metal plate 501 formed of, for example, tinned plate are disposed in the transport path K. The metal plate 501 neutralizes the non-image side of the print medium P and cooperates with the transport guide 502 to transport the print medium P to the fixing roller 206.

The metal plate 501 may be formed of a steel plate to which electroless nickel plating is applied, and which has a thickness t=0.15 mm. A neutralization voltage V2 is applied to the metal plate 501 for neutralizing the charge on the non-image side of the print medium P. The neutralization voltage V2 is supplied from a variable voltage power supply 503.

Figure 8:
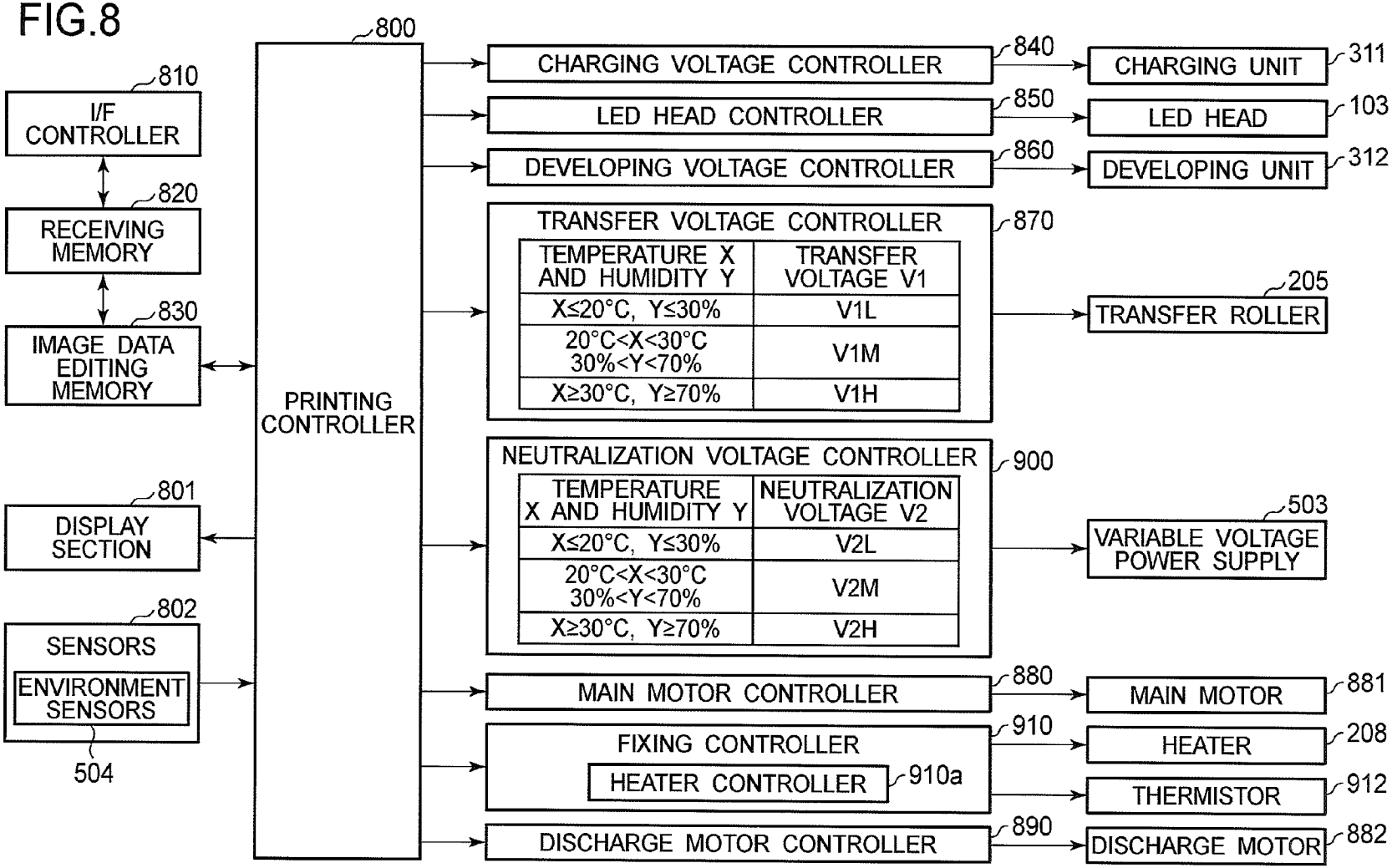
FIG. 8 is a block diagram of a controller according to the second embodiment.

The configuration of a controller according to the second embodiment will be described. FIG. 8 is a block diagram of the controller.

A printing controller 800 includes a micro processor, a read only memory (ROM), a random access memory (RAM), and I/O port, and a timer. The printing controller 800 receives print data and control commands from a host apparatus (not shown), controls the overall operation of the printer, and performs the printing operation of the received print data.

A display section 801 includes a display unit in the form of, for example, a liquid crystal display (LCD) (not shown), and displays the status of the printer to the user.

Sensors 802 include, for example, a plurality of paper position sensors that detect the position of the print medium P in the transport path K and a density sensor that detects the density of images during calibration of print density, and environment sensors 504 or environment condition detectors that detect the temperature and humidity in the printer. The outputs of the sensors 802 are sent to the printing controller 800 and to the display unit 801. The display unit 801 displays the status of the printer to the user via a display device such as an LCD. In the second embodiment, the environment sensors 504 output a temperature value X, whose initial value is X=25° C. and a humidity value Y whose initial value is Y=50%.

An I/F controller 810 transmits information about the printer to the host apparatus, and analyzes control commands received from the host apparatus to process the received data.

A receiving memory 820 stores the data received from the host apparatus via the I/F controller 810.

An image data editing memory 830 is used in editing the print data, received from the host apparatus through the I/F controller 810, into image data. The image data editing memory 830 receives the print data from the receiving memory 820, edits into image data, and stores the edited image data therein. The image data is outputted to an LED head controller 850.

A charging voltage controller 840 applies a charging voltage to a charging unit 311 in accordance with the command from the printing controller 800, thereby controllably charging the photoconductive drum 204.

An LED head controller 850 drives the LED head 103 to illuminate the charged surface of the photoconductive drum 204 in accordance with the image data held in the image data editing memory 830. In other words, the LED head controller 850 outputs the image data to the LED head 103 at a predetermined timing.

A developing voltage controller 860 controls the developing voltage applied to the developing unit 312, thereby depositing the toner to the electrostatic latent image formed on the photoconductive drum 204.

A transfer voltage controller 870 controls the transfer voltage V1 applied to the transfer roller 205, thereby transferring the toner image onto the print medium P. Also, the transfer voltage controller 870 controls the transfer voltage V1 applied to the transfer roller 205 in accordance with the temperature X and humidity Y obtained from the environment sensors 504, the voltage V1 being V1L for X≤20° C. and Y≤30%, V1H for X≥30° C. and Y≥70%, and V1M for 20° C.<X<30° C. and 30%<Y<70%. In the second embodiment, V1L=3 kV, V1M=2.1 kV, V1H=1.8 kV and V1=1.2 kV.

A main motor controller 880 controls a main motor 881 that drives the photoconductive drum 204, the charging unit 311, the developing unit 312, and the transport rollers used for advancing the print medium P in the transport path K of the print medium P.

A neutralization voltage controller 900 controls a neutralization voltage V2 applied to the metal plate 501 through a variable voltage power supply 503, thereby removing the charge remaining on the non-image side of the print medium P both when the print medium P is passing through the transfer point defined between the photoconductive drum 204 and when the print medium P has passed the transfer point. The neutralization voltage controller 900 controls the neutralization voltage V2 applied to the metal plate 501 in accordance with the temperature X and the humidity Y, V2 being V2L for X≤20° C. and Y≤30%, V2H for X≥30° C. and Y≥70%, and V2M for 20° C.<X<30° C. and 30%<Y<70%. In the second embodiment, V2L=−300 V, V2M=0 V, V2H=100 V, and V2=0 V.

A fixing controller 910 controls the voltage applied to the heater 208 built in the fixing unit 106 in accordance with the command from the printing controller 800, thereby fixing the toner image on the print medium P. The fixing controller 910 drives the heater 208 to turn on and off in accordance with the temperature detected by the thermistor 912 that detects the temperature of the fixing unit 106.

The image forming process of a printer having the aforementioned configuration is substantially the same image forming process described in the first embodiment, and the description thereof is omitted.

FIG. 9 illustrates the transfer voltage V1 and neutralization voltage V2 for various ranges of environment temperature X and environment humidity Y.

Figure 10:
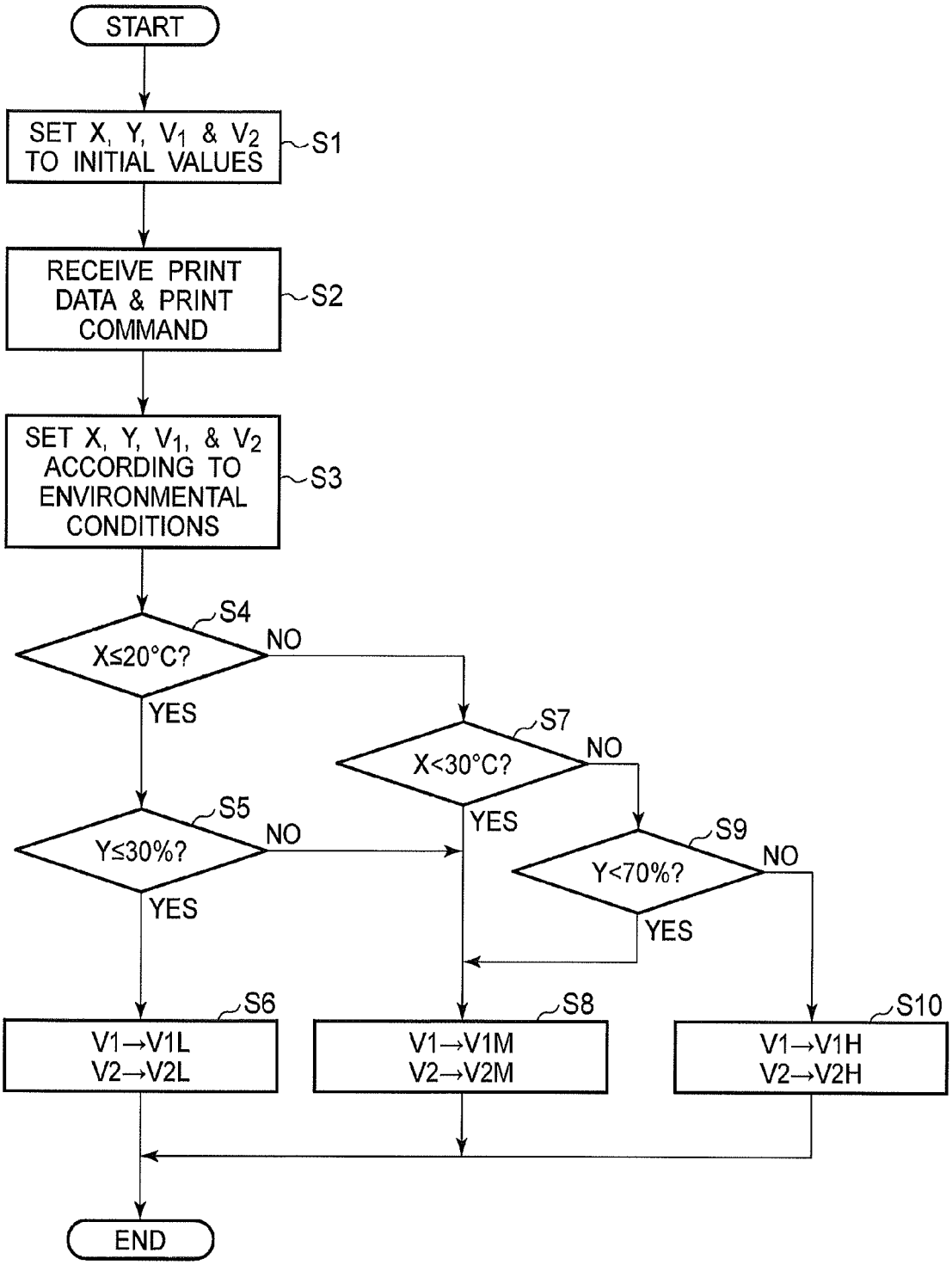
FIG. 10 is a flowchart illustrating the operation for setting the transfer voltage and the neutralization voltage.

FIG. 10 is a flowchart illustrating the operation for setting the transfer voltage V1 and neutralization voltage V2.

Next, the operation for setting the transfer voltage V1 and neutralization voltage V2 in accordance with the environment temperature and environment humidity will be described with reference to the flowchart shown in FIG. 10.

After power-up and prior to printing, the printing controller 800 initially sets the temperature value X to 25° C., humidity value Y to 50%, the transfer voltage V1 to 1.2 kV, and the neutralization voltage V2 to 0 V listed in FIG. 9 (S1).

Upon reception of a print command from a host apparatus (S2), the printing controller 800 obtains the values for the temperature X and the humidity Y from the environment sensors 504 (S3). If the X is not higher than 20° C. (Y at S4), the printing controller 800 determines that the printer is in a low-temperature environment.

If the Y is not higher than 30% (Y at S5), the printing controller 800 determines that the printer is in a low-humidity environment. The printing controller 800 then sets the transfer voltage V1 to V1L and the neutralization voltage V2 to V2L (S6), and then completes the setting operation.

If the Y is higher than 30% (N at S5), the printing controller 800 determines that the printer is not in a low-humidity environment, and sets the transfer voltage V1 to V1M and the neutralization voltage V2 to V2M (S8), and then completes the setting operation.

If the X is higher than 20° C. (N at S4), the printing controller 800 makes a decision to determine whether the X is lower than 30° C. at S16. If the X is lower than 30° C. (Y at S7), the printing controller 800 determines that the printer is not in a high-temperature environment, and sets the transfer voltage V1 to V1M and the neutralization voltage V2 to V2M (S8), and then completes the setting operation.

If the X is higher than 30° C. (N at S7), the printing controller 800 determines that the printer is in a high-temperature environment.

If the Y is lower than 70% (Y at S9), the printing controller 800 determines that the printer is not in a high-humidity environment, and sets the transfer voltage V1 to V1M and the neutralization voltage V2 to V2M (S8), and then completes the setting operation.

If the Y is not lower than 70% (N at S9), the printing controller 800 determines that the printer is in a high-temperature and high-humidity environment, and sets the transfer voltage V1 to V1H and the neutralization voltage V2 to V2H (S10), and then completes the setting operation.

The printing controller 800 controls the transfer voltage V1 and neutralization voltage V2 based on the thus obtained voltage values. The neutralization voltage V2 is applied to the metal plate 501 via the variable voltage power supply 503.

While the second embodiment has been described in terms of a metal plate formed of a steel plate, which is electroless nickel plated, if rust and changes in dielectric constant can be known, the metal plate 501 may of course be formed of tinplate which has a higher dielectric constant.

Although the second embodiment has been described in terms of the configuration in which the transfer voltage V1 and neutralization voltage V2 are set based on the values detected by the environment sensors 504, the transfer voltage V1 and neutralization voltage V2 may also be set based on information on the environment received from external equipment such as a host apparatus. Further, the neutralization voltage V2 is set based on both the temperature X and humidity Y obtained from the environment sensors 504. Of course, the neutralization voltage V2 may be set based on either the temperature X or the humidity Y.

While the second embodiment has been described with respect to three preselected values of the neutralization voltage V2 based on the temperature X and humidity Y, the neutralization voltage V2 may be determined by calculation using an equation based on the individual values of temperature X and humidity Y.

As described above, the second embodiment sets the transfer voltage V1 and neutralization voltage V2 in accordance with the environment temperature X and humidity Y. This not only provides the same effects as the first embodiment but also minimizes damage to printed images and provides stable transportation of the print medium P with stable neutralization.

The present invention has been described with respect to a transfer roller, the invention is not limited to this, and may be applicable to a transfer belt. The invention has been described in terms of an electrophotographic printer that employs LED heads. The invention may also be applied to laser printers and intermediate transfer printers.

What is claimed is:

1. An image forming apparatus comprising:

a guide member located downstream of a transfer section, the guide member guiding a print medium that carries a developer image thereon, the print medium being transported in a transport path; and an attracting member extending in a direction parallel to the transport path, and disposed at a position where when the print medium is guided by the guide member, the attracting member attracts the print medium toward the attracting member such that the guide member is positioned between the print medium and the attracting member, a gap being formed between the attracting member and the print medium to prevent the print medium from directly contacting the attracting member as the print medium passes by the attracting member.

2. The image forming apparatus according to claim 1, wherein the developer image is negatively charged when the print medium passes through the transfer section, and the attracting member is connected to a ground potential so that the print medium is attracted electrostatically by the attracting member.

3. The image forming apparatus according to claim 1, further comprising a neutralizing member that neutralizes a non-image side of the print medium, wherein the attracting member and the neutralizing member are a single piece construction.

4. An image forming apparatus comprising:

a guide member located downstream of a transfer section, the guide member guiding a print medium that carries a developer image thereon, the print medium being transported in a transport path;

an attracting member extending in a direction parallel to the transport path, and disposed at a position where when the print medium is guided by the guide member, the attracting member attracts the print medium toward the attracting member such that the guide member is sandwiched between the print medium and the attracting member;

an environmental condition detector that detects environmental conditions in the image forming apparatus;

a power supply that applies a voltage to the attracting member so that the print medium is attracted electrostatically by the attracting member; and a controller configured to control the power supply based on the environmental conditions so that the power supply changes the voltage in accordance with the environmental conditions.

5. The image forming apparatus according to claim 4, wherein the power supply is a first power supply of a plurality of power supplies and the voltage is a first voltage, wherein the image forming apparatus comprises a second power supply that applies a second voltage to the transfer section; and wherein the controller is configured to control the second power supply based on the environmental conditions so that the second power supply changes the second voltage in accordance with the environmental conditions.

6. The image forming apparatus according to claim 4, wherein the environmental condition detector is a humidity sensor.

7. The image forming apparatus according to claim 4, wherein the environmental condition detector is a temperature sensor.

8. The image forming apparatus according to claim 1 further comprising:

a neutralizing member that neutralizes a non-image side of the print medium;

a space defining member that is upstream of the neutralizing member in the transport path and defines a gap between the print medium and the neutralizing member when the print medium is transported in the transport path after passing through the transfer section; and wherein the attracting member attracts the print medium after the non-image side of the print medium is neutralized by the neutralizing member.

9. The image forming apparatus according to claim 8, further comprising a support member, wherein the attracting member and the neutralizing member are formed of metal and are supported by the support member.

10. The image forming apparatus according to claim 9, wherein the guide member, the space defining member, and the support member are a single piece construction.

11. The image forming apparatus according to claim 1, wherein the gap is disposed between the attracting member and the print medium so that the attracting member is free of any contact with all of the print medium for all the print medium passing by the attracting member.

12. The image forming apparatus according to claim 1, wherein the attracting member is electrically conductive and is connected to a predetermined potential.

13. The image forming apparatus according to claim 1, wherein a portion of the attracting member is configured to neutralize charges on the print medium.

14. The image forming apparatus according to claim 13, further comprising a neutralizing member located at an upstream portion of the attracting member.

15. The image forming apparatus according to claim 14, wherein the attracting member and the neutralizing member are formed in a single piece structure.

16. The image forming apparatus according to claim 15, wherein the attracting member and the neutralizing member are parts of a metal plate, and the neutralizing member is formed by bending a portion of the metal plate.

17. The image forming apparatus according to claim 16, wherein in a cross-sectional view of the image forming apparatus, the attracting member and the neutralizing member have longitudinal axes that are not parallel to each other.

18. The image forming apparatus according to claim 1, wherein the print medium is transported in contact with the guide member, and the attracting member is assembled to the guide member so that the guide member places the attracting member in position relative to the print medium.

* * * * *